US011694832B2

(12) United States Patent
Jacobson et al.

(10) Patent No.: US 11,694,832 B2
(45) Date of Patent: Jul. 4, 2023

(54) HIGH VOLTAGE HIGH FREQUENCY TRANSFORMER

(71) Applicant: Raytheon Company, Waltham, MA (US)

(72) Inventors: Boris S. Jacobson, Westford, MA (US); Sara Lorene Makowiec, Framingham, MA (US); Lev Volfson, Framingham, MA (US)

(73) Assignee: RAYTHEON COMPANY, Waltham, MA (US)

( * ) Notice: Subject to any disclaimer, the term of this patent is extended or adjusted under 35 U.S.C. 154(b) by 1081 days.

(21) Appl. No.: 16/264,906

(22) Filed: Feb. 1, 2019

(65) Prior Publication Data

US 2020/0251271 A1 Aug. 6, 2020

(51) Int. Cl.

| | |
|---|---|
| ***H01F 27/24*** | (2006.01) |
| ***H01F 41/02*** | (2006.01) |
| ***H01F 41/04*** | (2006.01) |
| ***H01F 27/28*** | (2006.01) |

(52) U.S. Cl.

CPC ..... *H01F 27/24* (2013.01); *H01F 27/28* (2013.01); *H01F 41/0206* (2013.01); *H01F 41/04* (2013.01)

(58) Field of Classification Search

USPC ..... 336/170, 5, 55–60

See application file for complete search history.

(56) References Cited

U.S. PATENT DOCUMENTS 3,195,083 A 7/1965 Wetherll
4,942,353 A 7/1990 Herbert et al.
4,977,301 A 12/1990 Maehara et al.
4,978,906 A 12/1990 Herbert et al.
5,312,674 A 5/1994 Haertling et al.
5,745,981 A 5/1998 Roshen et al.
5,777,539 A 7/1998 Folker et al.
5,959,522 A 9/1999 Andrews
5,973,923 A 10/1999 Jitaru
5,990,776 A 11/1999 Jitaru
5,999,078 A 12/1999 Herbert
6,281,779 B1 * 8/2001 Matsumoto ..... H01F 27/2804 336/200
6,445,272 B1 9/2002 Mercado et al.
(Continued)

OTHER PUBLICATIONS

Final Office Action for U.S. Appl. No. 16/264,849, dated Dec. 13, 2021, 10 pages.

(Continued)

*Primary Examiner* — Shawki S Ismail
*Assistant Examiner* — Kazi S Hossain
(74) *Attorney, Agent, or Firm* — Cantor Colburn LLP

(57) ABSTRACT

A transformer includes a closed loop core having a first leg and a second leg. The transformer also includes a first primary winding surrounding the first and second legs, a second primary winding surrounding the first and second legs, and first and second secondary windings surrounding the first and second legs, respectively, and disposed between the first and second primary windings. A first turn of the first and second secondary windings are disposed on a first interlayer winding layer, and other turns of the first and second secondary windings are disposed on a first layer that is further from the first primary winding than the first interlayer winding layer.

3 Claims, 14 Drawing Sheets

(56) References Cited

U.S. PATENT DOCUMENTS

| | | | | |
|---|---|---|---|---|
| 6,628,531 | B2 | 9/2003 | Dadafshar | |
| 6,727,793 | B2 | 4/2004 | Piechnick | |
| 6,820,321 | B2 | 11/2004 | Harding | |
| 6,847,284 | B2 | 1/2005 | Gamou et al. | |
| 7,084,728 | B2 | 8/2006 | Hyvönen | |
| 7,187,263 | B2 | 3/2007 | Vinciarelli | |
| 7,199,569 | B1 * | 4/2007 | Nakahori | H02M 3/335 336/180 |
| 7,248,138 | B2 | 7/2007 | Chiang et al. | |
| 7,262,680 | B2 | 8/2007 | Wang | |
| 7,304,862 | B2 | 12/2007 | Busletta et al. | |
| 7,361,847 | B2 | 4/2008 | Dunn et al. | |
| 7,382,219 | B1 | 6/2008 | Lee | |
| 8,089,331 | B2 | 1/2012 | Jacobson et al. | |
| 8,536,971 | B1 | 9/2013 | Waseem et al. | |
| 8,593,245 | B2 | 11/2013 | Zeng et al. | |
| 9,349,523 | B2 | 5/2016 | Jacobson et al. | |
| 9,524,820 | B2 | 12/2016 | Jacobson et al. | |
| 9,564,266 | B2 | 2/2017 | Jacobson et al. | |
| 9,730,366 | B2 | 8/2017 | Jacobson et al. | |
| 2002/0113679 | A1 * | 8/2002 | Takayama | H01F 30/10 336/65 |
| 2008/0266042 | A1 | 10/2008 | Yoshimura et al. | |
| 2009/0109710 | A1 | 4/2009 | Nakahori | |
| 2010/0232181 | A1 * | 9/2010 | Nakahori | H01F 27/2804 336/221 |
| 2010/0321960 | A1 * | 12/2010 | Nakahori | H01F 27/2804 363/21.04 |
| 2012/0223797 | A1 | 9/2012 | Won et al. | |
| 2017/0133151 | A1 | 5/2017 | Jacobson | |
| 2017/0309395 | A1 | 10/2017 | Shiraki et al. | |
| 2018/0226182 | A1 | 8/2018 | Fe et al. | |
| 2019/0043661 | A1 | 2/2019 | Jin et al. | |
| 2019/0088411 | A1 | 3/2019 | Zhi et al. | |

OTHER PUBLICATIONS

Restriction Requirement for U.S. Appl. No. 16/264,849, dated Apr. 28, 2021, 6 pages.

U.S. Non-Final Office Action for U.S. Appl. No. 16/264,849, dated Aug. 2, 2021, 18 pages.

* cited by examiner

HIGH VOLTAGE HIGH FREQUENCY TRANSFORMER

BACKGROUND

The present invention relates to providing power and, more specifically, to providing a compact, high-voltage, high-frequency transformer to provide power.

Power converters are used to convert power from an input to a needed power for provision to a load. One type of power converter is a transformer. Transformers may be designed to convert a fixed AC input voltage into a higher or lower AC voltage. The architecture chosen may provide for high frequency operation, pulse-width-modulation, isolation, and the like.

Different types of transformers may be used depending on a particular application. A typical power transformer includes one or more input windings and one or more output windings. The input and output windings are both wrapped around a core formed of a magnetic material. An alternating current provided at the input (e.g., primary) windings causes a varying magnetic flux in the transformer core. This flux leads to a time varying magnetic field that includes a voltage in the output (e.g., secondary) windings of the transformer.

In some cases, the core is so-called "closed-core." An example of closed-core is a "shell form" core. In a shell form, the primary and secondary windings are both wrapped around a central core leg and a both surrounded by outer legs. In some cases, more than one primary winding is provided and multiple secondary windings may also be provided. In such systems, based on the input and to which of the primary windings that input is provided (of course, power could also be provided to more than one primary winding in some instances) different output voltages can be created at each of the secondary windings.

Some power transformers operate at high voltages and/or currents. Such power transformers may produce strong electromagnetic (EM) fields. One approach to deal with the electric fields and parasitic currents they produce is to shield one or both of the primary and secondary windings. This may be especially important where the power transformer operates in high, very-high or ultra-high frequency bands. An example is a power transformer used in a microwave power module.

In some applications, the cost of high current/high voltage transformers for use in compact equipment can be high relative to the cost of the equipment as a whole or compared to other elements in the equipment. Further, in some cases, the transformer can be difficult to make or are prone to failures.

SUMMARY

According to one embodiment a transformer that includes a closed loop core having a first leg and a second leg is disclosed. The transformer of this embodiment includes: a first primary winding surrounding the first and second legs; a second primary winding surrounding the first and second legs; and first and second secondary windings surrounding the first and second legs, respectively, and disposed between the first and second primary windings. In this embodiment, a first turn of the first and second secondary windings are disposed on a first interlayer winding layer, and other turns of the first and second secondary windings are disposed on a first layer that is further from the first primary winding than the first interlayer winding layer.

According to any prior embodiment, a second turn of the first and second secondary windings is disposed on a second interlayer winding layer that is closer to the second primary winding than the other turns of the first and second secondary windings.

According to any prior embodiment, the transformer further includes third and fourth secondary windings surrounding the first and second legs, respectively, and disposed between the first and second primary windings. A first turn of the third and fourth secondary windings is disposed on the first interlayer winding layer, and other turns of the third and fourth secondary windings are disposed on a second layer that is further from the first interlayer winding layer than the first layer.

According to any prior embodiment, the transformer further includes fifth and sixth secondary windings surrounding the first and second legs, respectively, and disposed between the first and second primary windings. A first turn of the fifth and sixth secondary windings is disposed on the first interlayer winding layer, and other turns of the fifth and sixth secondary windings are disposed on a third layer that is further from the first interlayer winding layer that the second layer. The transformer can also include seventh and eighth secondary windings surrounding the first and second legs, respectively, and disposed between the first and second primary windings. A first turn of the seventh and eighth secondary windings is disposed on the first interlayer winding layer, and other turns of the seventh and eighth secondary windings are disposed on a fourth layer that is further from the first interlayer winding layer that the third layer.

According to any prior embodiment, the first and second primary windings are connected in parallel or in series.

According to any prior embodiment, the transformer further includes a first enclosure that includes the first primary winding; a second enclosure that includes the second primary winding; and a third enclosure that includes the first secondary winding and the second secondary winding.

According to any prior embodiment, the third enclosure includes the third, fourth, fifth, sixth, seventh and eighth secondary windings.

Also disclosed is a method of forming a transformer. This method includes: forming a closed loop core having a first leg and a second leg; surrounding the first and second legs with a first primary winding; surrounding the first and second legs with a second primary winding; and surrounding the first and second legs, respectively, with first and second secondary windings between the first and second primary windings, including forming a first turn of the first and second secondary windings on a first interlayer winding layer, and forming other turns of the first and second secondary windings on a first layer that is further from the first primary winding than the first interlayer winding layer.

According to any prior method, surrounding the first and second legs with first and second secondary windings includes forming a second turn of the first and second secondary windings on a second interlayer winding layer that is closer to the second primary winding than the other turns of the first and second secondary windings.

According to any prior method, the method can further include surrounding the first and second legs, respectively, with third and fourth secondary windings between the first and second primary windings. A first turn of the third and fourth secondary windings is disposed on the first interlayer winding layer, and other turns of the third and fourth secondary windings are disposed on a second layer that is further from the first interlayer winding layer than the first layer.

According to any prior method, the method can further include surrounding the first and second legs, respectively, with fifth and sixth secondary windings between the first and second primary windings. A first turn of the fifth and sixth secondary windings is disposed on the first interlayer winding layer, and other turns of the fifth and sixth secondary windings are disposed on a third layer that is further from the first interlayer winding layer that the second layer. The method can also further include surrounding the first and second legs, respectively, with seventh and eighth secondary windings between the first and second primary windings. A first turn of the seventh and eighth secondary windings is disposed on the first interlayer winding layer, and other turns of the seventh and eighth secondary windings are disposed on a fourth layer that is further from the first interlayer winding layer that the third layer.

According to any prior method, the method can further include connecting the wherein the first and second primary windings in parallel or in series.

According to a second embodiment, a transformer that includes a closed loop core having a first leg and a second leg is disclosed. The transformer of this embodiment includes a first primary winding surrounding the first leg, a second primary winding surrounding the first leg, and first and second secondary windings surrounding the first leg and disposed between the first and second primary windings. The first and second secondary windings are disturbed on four levels, with two turns of each of the first and second secondary windings being on each of the four levels, and current flows in a first direction around the first leg in the first secondary winding and current flows in second direction around the first leg in the second secondary winding, the second direction being opposite the first direction.

According to any prior aspect of the second embodiment, the transformer can also include: a third primary winding surrounding the second leg; a fourth primary winding surrounding the second leg; and third and fourth secondary windings surrounding the second leg and disposed between the third and fourth primary windings. The third and fourth secondary windings are disturbed on the four levels, with two turns of each of the third and fourth secondary windings being on each of the four levels, current flows in first direction around the second leg in the third secondary winding and current flows in second direction around the second leg in the second secondary winding, the second direction being opposite the first direction.

According to any prior aspect of the second embodiment, the transformer can also include: a first enclosure that includes the first primary winding; a second enclosure that includes the second primary winding; and a third enclosure that includes the first secondary winding and the second secondary winding.

According to any prior aspect of the second embodiment, the third enclosure includes the third and fourth secondary windings.

According to any prior aspect of the second embodiment, the first enclosure includes the third primary winding and the second enclosure includes the fourth primary winding A second method of forming transformer is also disclosed. This second method includes: forming a closed loop core having a first leg and a second leg; surrounding the first leg with a first primary winding; surrounding the first leg with a second primary winding; and surrounding the first leg with first and second secondary windings between the first and second primary windings. The first and second secondary windings are disturbed on four levels, with two turns of each of the first and second secondary windings being on each of the four levels, and current flows in a first direction around the first leg in the first secondary winding and current flows in second direction around the first leg in the second secondary winding, the second direction being opposite the first direction.

In any prior aspect of the second method, the method can also include: surrounding the second leg with a third primary winding; surrounding the second leg with a fourth primary winding; and surrounding the second leg with third and fourth secondary windings between the third and fourth primary windings. The third and fourth secondary windings are disturbed on the four levels, with two turns of each of the third and fourth secondary windings being on each of the four levels, and current flows in first direction around the second leg in the third secondary winding and current flows in second direction around the second leg in the second secondary winding, the second direction being opposite the first direction.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Disclosed herein are embodiments of a high voltage high current (HVHC) transformers. One or more of these embodiments can have the effect of keeping inductive losses lower while still keeping sufficient distances between windings to avoid breakdowns between the winding. The embodiments herein are based on a general construct that includes at least one closed core having two core legs with primary and secondary windings disposed around both legs.

Figure 1:
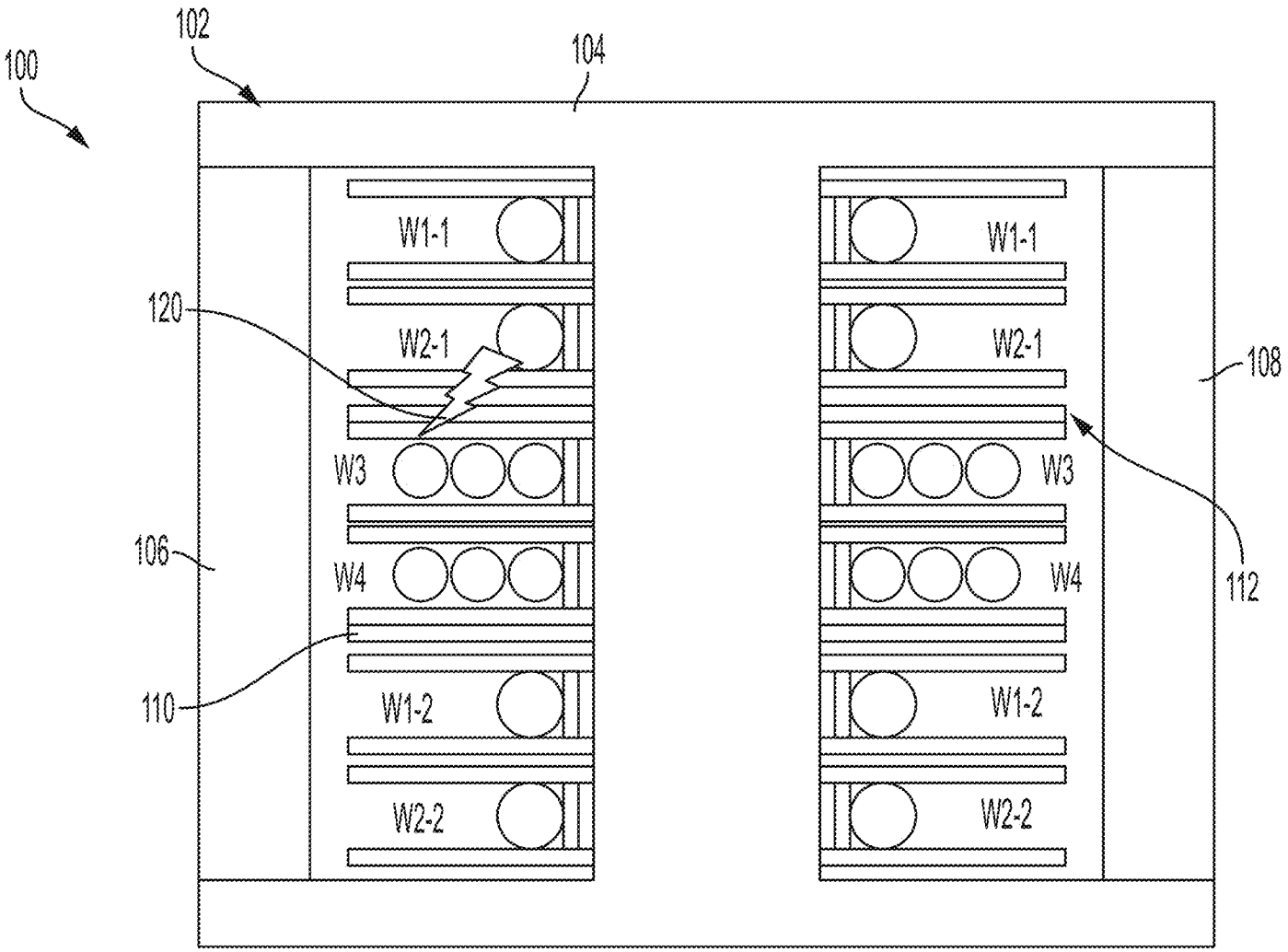
FIG. 1 PRIOR ART
FIG. 1 shows a cross section of a prior art transformer with multiple primary and multiple secondary windings and a shell form core.

FIG. 1 shows an example of a prior art transformer. As illustrated, the transformer 100 includes a core 102. The core 102 may be formed in the prior art and by a metal or other magnetically conductive material. Examples includes include ferromagnetic metal such as iron, or ferromagnetic compounds such as ferrites. Other examples include laminated silicon steel. The core 102 of FIG. 1 is of the closed variety and in particular to a shell core having a central leg 104 and outer legs 106, 108.

As illustrated, the transformer 100 includes four primary windings, each having a single turn and are labelled as a first primary winding W1-1, a second primary winding W2-1, a third primary winding W1-2 and a fourth primary winding W2-1. In this and other examples, the primary windings are part of the so-called "low voltage" side of the transformer and each include one spiral The illustrated transformer includes two secondary windings W3 and W4 both formed of three spirals. In this and other examples, the secondary windings are part of the so-called "high voltage" side of the transformer and each include 3 spirals turns. A low voltage provided to the one or more of the primary winding creates a higher voltage in the secondary windings. Of course, if the number of spirals one the primary and secondary could be changed.

In the example shown in FIG. 1, the primary windings are shielded from the secondary windings W3, W4 by shields 110 and 112. The shields 110, 112 can be an electrostatic shield formed of a conductive metal such a copper. The shields 110, 112 may minimize conducted (coupled through parasitic capacitance) and radiated emissions from secondary-winding high-voltage spikes being transmitted to the primary windings or vice-versa. In some cases, the shield is placed between a transformer's primary and secondary windings to reduce EMI and usually consists of one turn of thin copper foil around the secondary windings. The shield 110 may be coupled to a circuit or system ground that is attached to prevent high-frequency current from coupling.

HVHC transformers need multiple winding layers to reduce copper losses and wide spacing between windings to prevent corona/breakdown (see, e.g., example breakdown 120). However, increasing the spacing between, for example, the primary and secondary windings (e.g., W2-1 and W3) increases leakage inductance (Ls). Increasing Ls can reduce efficiency in many converter circuits. In parallel resonant converters with multiple output windings, Ls creates undesired second-order resonances disrupting converter operation and creating stray fields. Stray field associated with Ls increases EMI.

Based on the below teachings, one technical effect of disclosure herein is to provide an HVHC transformer that can achieve both long-term corona free operation and low Ls between multiple windings.

One approach to reduce Ls is to increase the number of winding sections mounted on separate legs of the transformer's magnetic core. Ls is proportional to the square of magnetic field H (expressed in oersteds below):

$$H=0.4*\pi*I*n/l$$

where I is current, n is number of turns, l is magnetic path length.

Added winding sections allow for reduction in magnitude of the transformer magnetic field (H) and the associated leakage inductance. Further, series/parallel connections of multiple winding sections can reduce the number of turns, current, or both in each winding section.

Figure 2:
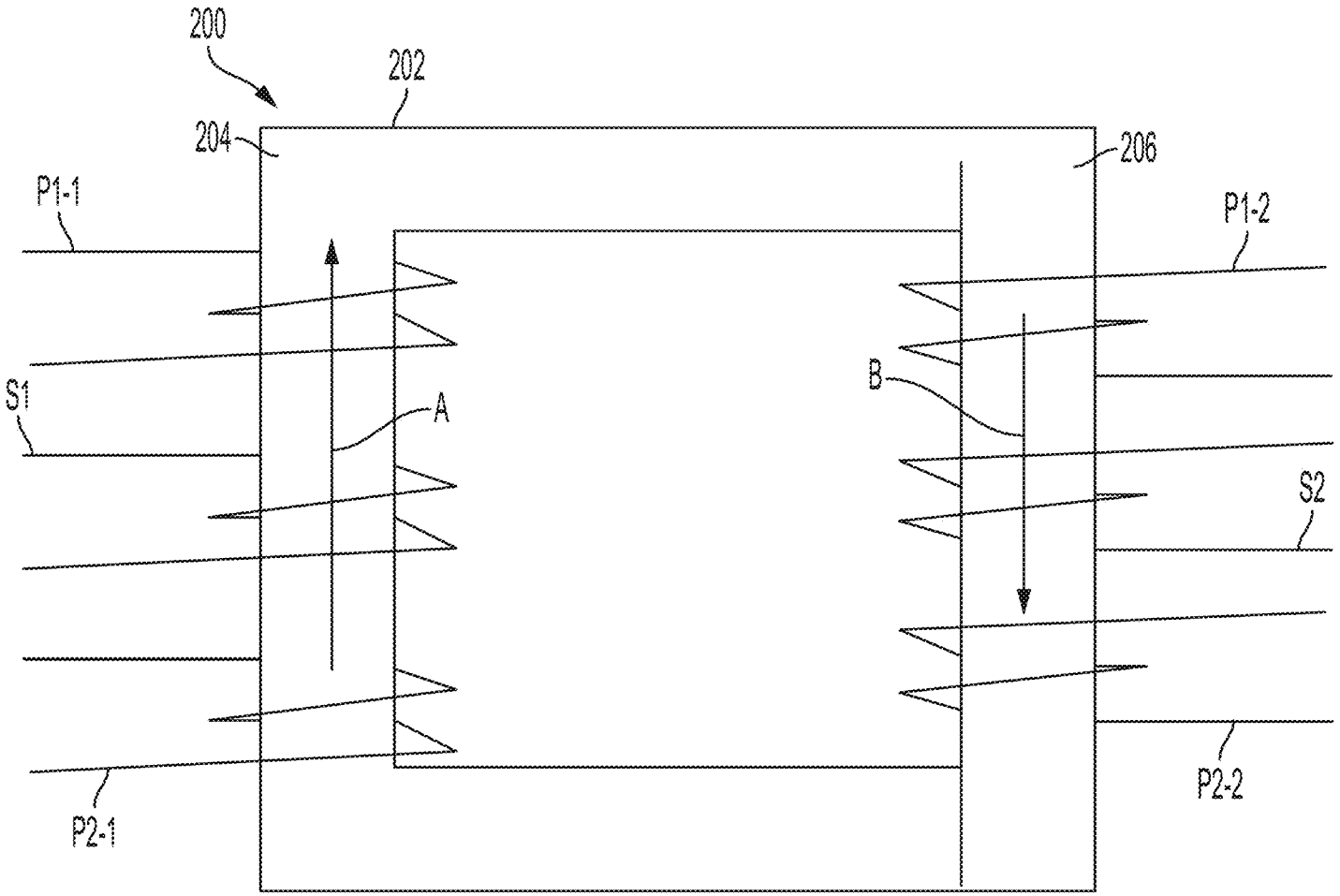
FIG. 2 shows a schematic of a multiple primary, multiple secondary transformer with first and second core legs according to one embodiment.

FIG. 2 shows a simplified version an HVHC transformer 200 according to one embodiment. This embodiment may reduce Ls by increasing the number interleaved winding section mounted on separate legs of a magnetic core. In FIG. 2, the transformer 200 includes a closed loop core 202 having first and second legs 204, 206.

Each leg includes two primary windings. In particular, leg 204 includes primary windings P1-1 and P2-1 and leg 206 includes primary windings P1-2 and P2-2. In one embodiment, the primary windings can be arranged such that when a current is provided to them, flux lines are created in the core 202 in the directions shown in FIG. 2 by arrows A and B. In one embodiment, the flux lines A and B are configured to be in opposite directions.

As shown, primary windings P1-1 and P2-1 cause flux lines in direction A leg 204 and primary windings P1-2 and P2-2 cause flux lines in direction B in leg 206. The flux lines will, of course, result in a current being created in the output windings S1 and S2.

Based on the above, in one embodiment there is provided an HVHC transformer that includes a core having a first leg 204 and a second leg 206. The HVHC includes multiple windings including four primary windings (P1-1, P1-2, P2-1 and P2-2) and two secondary windings (S1-S2). Two primary windings (P1-1, P1-2) are formed around the first leg 204 and two primary windings (P2-1, P2-2) are formed around the second leg 206. In one embodiment, the windings on the first leg 204 are wrapped in a direction opposite to those on the second leg 204. On each leg at least one secondary winding is disposed between the primary windings. For example, secondary winding S1 is between primary windings P1-1 and P1-2 on the first leg 204 and secondary winding S2 is between primary windings P2-1 and P2-2 on the first leg 206.

Such a configuration can allow for the series or parallel connection of multiple windings to allow for a reduction of the number of turns, current, or both in each individual winding.

Figure 3:
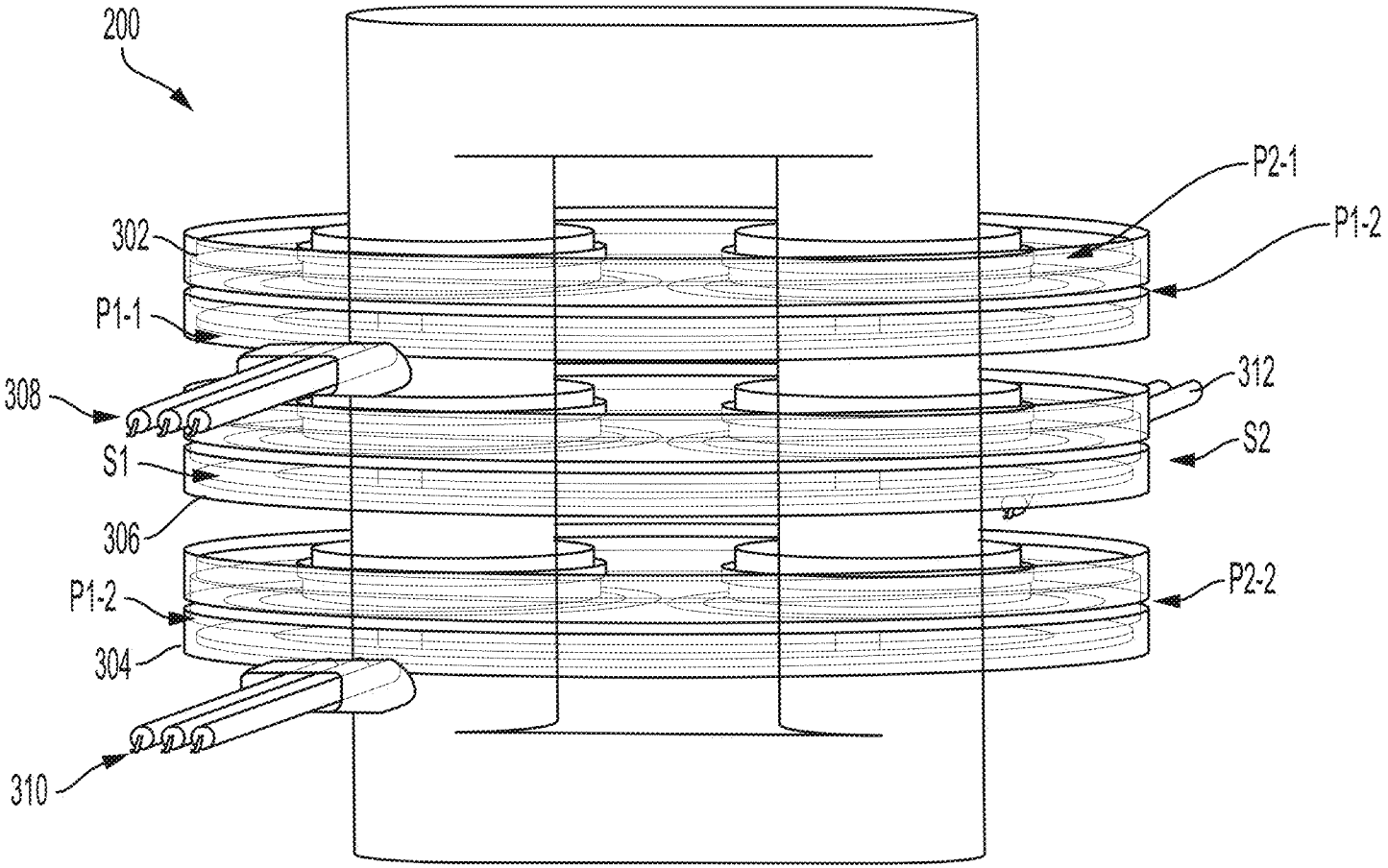
FIG. 3 shows a perspective view of the transformer of FIG. 2 including enclosures.

In order to produce a transformer such as transformer 200, enclosures can be provided to house the windings. For example, and with reference now to FIG. 3, the "top" primary windings P1-1 and P1-2 on the first and second legs 204, 206 can respectively be contained in a first enclosure 302. While P1-1 and P1-2 are not clearly shown in FIG. 3, there are generally referenced as being inside of the first enclosure 302 by arrows. The same is true of P2-1 and P2-2 in second enclosure 304 and S1 and S2 in a third enclosure 306. The windings in each enclosure 302-306 can receive or output current via interconnects 308-312 respectively. The skilled artisan will realize that different configurations of the windings in a particular enclosure can be selected to achieve desired input/output characteristics of the transformer. For example, P1-1 and P1-2 could be connected in series or in parallel.

Figure 4A:
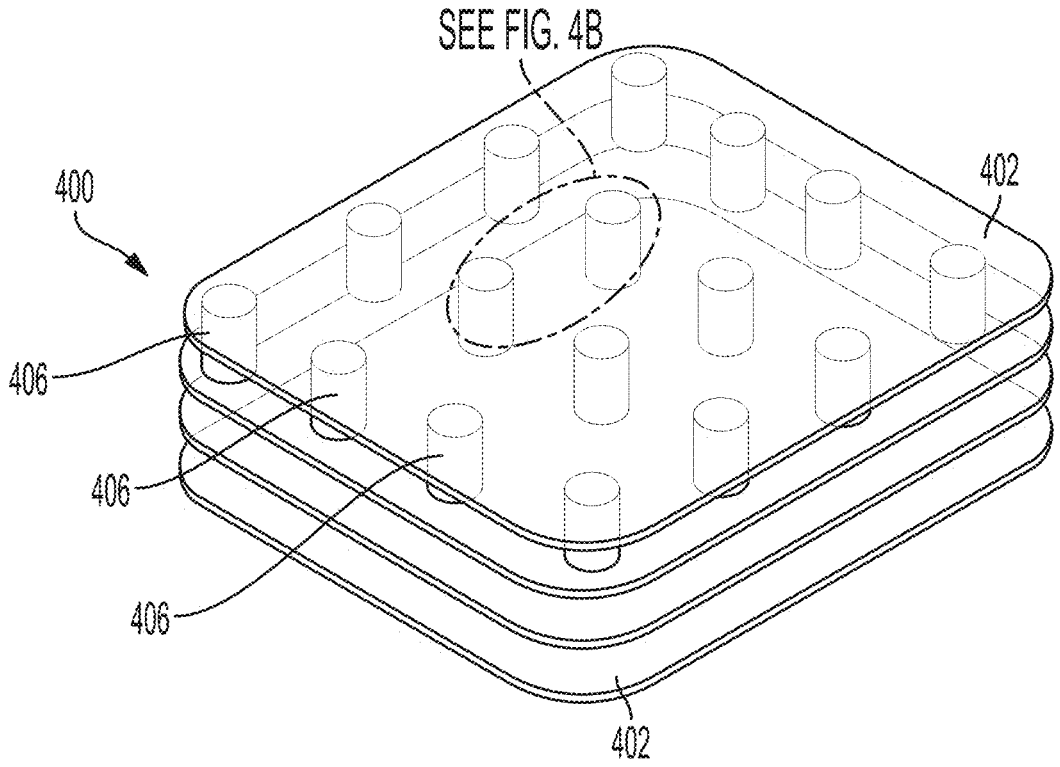
FIGS. 4A and 4B show a multi-leg transformer according to one embodiment.
Figure 4B:
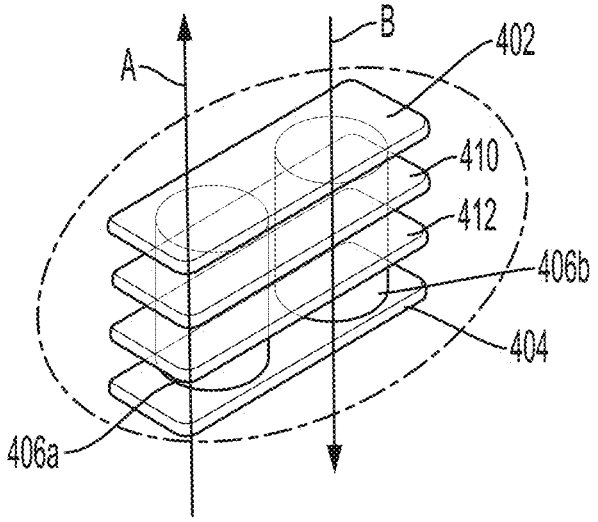

In some instances, the transformer may need to have and irregular or compact (or both) form factor. Increasing the number of core legs between common end plates can provide for such a transformer. In such a case, and with reference now to FIGS. 4A and 4B (collectively, FIG. 4), one embodiment of a transformer 400 takes advantage of the above teachings to include top and bottom end plates 402, 404 connected by a plurality of transformer legs 406. That is, the each of the legs above can be formed by plurality of leg segments 406.

Each transformer leg is surrounded by at least one primary winding contained, for example, in a first winding layer 410 and one or more secondary windings in a second winding layer 412. The windings in these layers are arranged such that flux will flow in one direction in some legs and in the opposite direction in at least one other leg. For example, flux may flow in direction A in leg 406*a* and direction B in leg 406*b*. In this manner, a first leg of the transformer is formed by plurality of leg segments 406*a* and a second leg of the transformer is formed by plurality of leg segments 406*b*.

It shall be understood that in the embodiment of FIG. 4, adding magnetic core legs (e.g., leg segments) and the corresponding number of interleaved winding sections enables a flexible structure with minimal number of enclosures. Each enclosure can have windings in different directions to ensure the desired flux directions.

Figure 5:
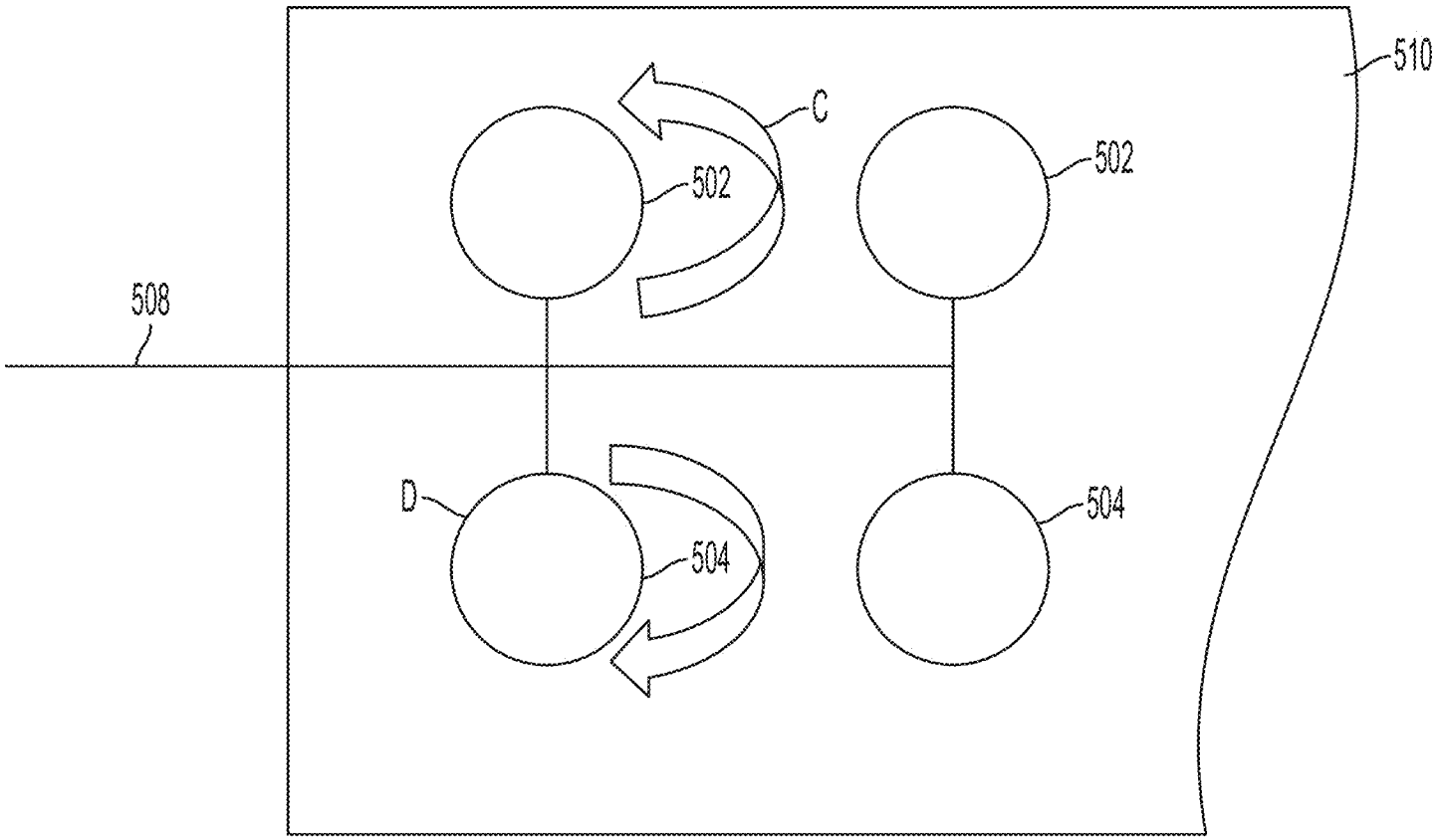
FIG. 5 a top view of windings that could be contained in one of the enclosures of a transformer.

For example, FIG. 5 shows a top view of windings that could be contained in one of the enclosures 410, 412. The windings include first direction windings 502 and second direction windings 504. The direction refers to a direction of current flow (as illustrated by arrows C and D) when current is applied via an input line 508.

With reference to both FIGS. 4 and 5, each winding 502, 504 will surround a leg when assembled. In one embodiment, the first direction windings 502 will surround, for example, eight legs to produce flux in direction A (e.g., leg segment 406*a*) and the second direction windings 504 will surround eight legs to produce flux in direction B (e.g., leg segment 406*b*). The number of first direction windings and second direction windings will generally be ½ the number of leg segments 406 in the transformer 400 as half will be used to produce flux in direction A and half in direction B.

The windings 502, 504 can be formed, for example, on a circuit board 510 that can be rigid or flexible. As shown, the windings are housed in two enclosures 410, 412. However, the number is not limited as any number of layers can be provided. For example, the three "layer" approach shown in FIG. 3 can be implemented with three enclosures in the arrangement of FIGS. 4-5. The enclosures can be formed of an insulating material such as plastic in one embodiment.

In one embodiment, if there are J magnetic core pairs (combination of leg segments 406*a*/406*b*), with K enclosures containing M winding sections per leg, can lead to N=J*K*M total number of winding sections. The windings in each section can be connected in parallel, series, or any combination thereof depending on the context.

In the above description one or more embodiments have been proposed that can reduce Ls by providing interleaved windings on two core legs (or a plurality of leg segments). In some cases, due to the needs of a particular transformer, one or more the windings can be fractional windings. In such a case, there can be large leakage flux in the regions where the winding does not surround the core. This leakage can increase EMI. To address this, a complementary fractional turn can be added so that the fractional turns, in combination, will completely surround the core.

Figure 6B:
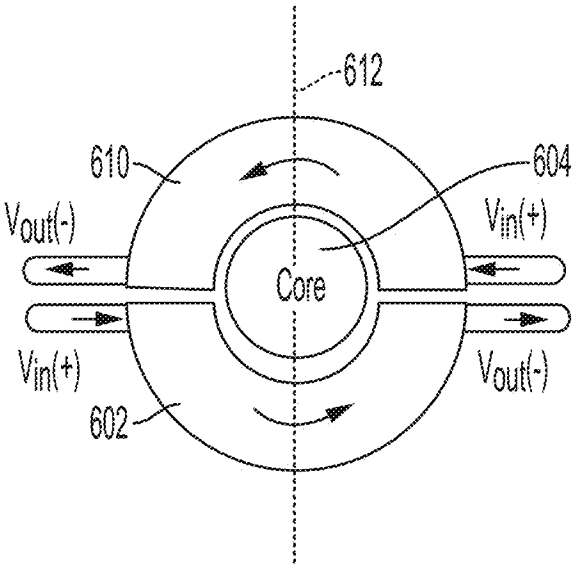
FIGS. 6*a* and 6*b* show fractional turns surrounding a transformer core leg.
Figure 6A:
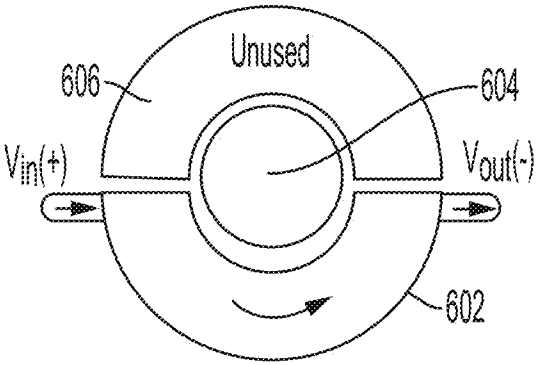

For example, with reference to FIGS. 6*a* and 6*b*, consider a first fractional or partial turn winding 602 (or "turn" for short) about a core leg 604. As shown the first fractional turn 602 is half turn but that is for example only and not meant to be limiting. The first turn 602 has an input Vin(+) and an output Vout(−). The portion of the core 604 not surrounded by the turn 602 is shown by a surround portion 606. This region can be described as having a large leakage field volume and increases EMI.

In FIG. 6*b* a complimentary fractional turn winding 610 is provided. It has a shape that is a mirror image of the first turn 602. The second turn has an input Vin(+) and an output Vout(−). The turns 602, 610 are arranged such that the current passing through them travels in opposite directions relative to a midline 612 of the core 604, consistent with the direction of magnetic flux in the core 604. As shown, there are two partial/fractional 602, 610 and neither one completely surrounds the core 604.

As so configured, both turns 602, 610 occupy similar positions in the magnetic field of the core 604 ensuring close magnetic coupling to the windings above and below. In one embodiment, the currents in the two turns 602, 610 are close in value (if not exactly equal) improving transformer efficiency and reducing stray fields.

It has been discovered that the inductance of conductors connecting turns 602, 610 to external circuitry adds to the transformer magnetizing and/or leakage inductance. One solution is to superimpose external interconnects so that their magnetic fields will cancel due to equal and opposite current in adjacent paths. For example, to connect the embodiment of FIG. 6*b*, two interconnects (traces) 620 and 622 may be required as shown in FIG. 6*c*

Figure 6D:
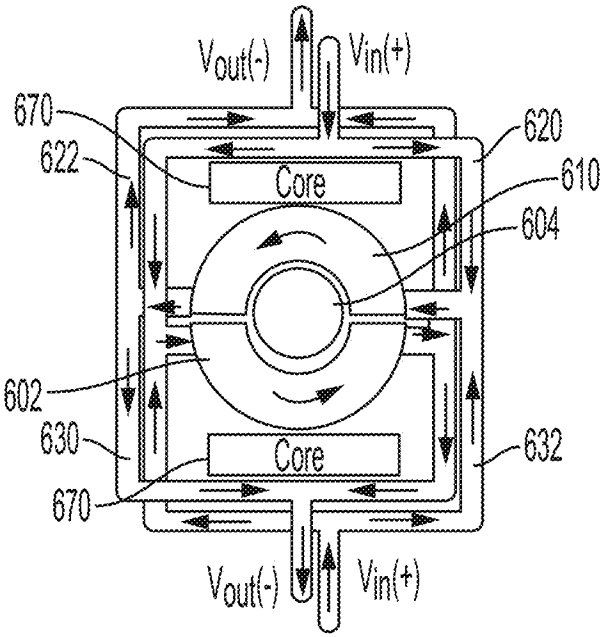
FIGS. 6*c*-6*e* show way in which fractional turns can be connected.
Figure 6C:
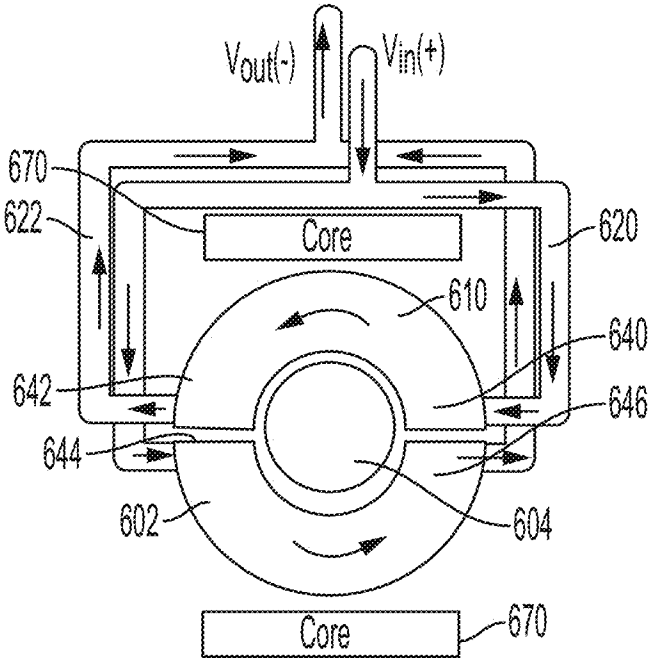

In FIG. 6*c* current paths are shown in by the arrows along each trace 620, 622 and the turns 602, 610. Such a configuration can allow for flexibility in interconnect locations in that they may be routed within the winding area without impacting the effective number of turns. Based on the above, it has been determined that for any fractional number of turns $$\frac{a}{d},$$

approximately a complementary traces, or any multiple of d, are required to implement this configuration. As shown in FIG. 6*d*, adding a second set of interconnects 630, 632 that mirror the first set 620, 622 further reduces stray magnetic fields.

As illustrated in FIGS. 6*c* and 6*d*, a first interconnect 620 connects to a first end 640 of the second fractional turn 610 and a first end 644 of the first fractional turn 602, and the second interconnect 622 connects to a second end 642 of the second fractional turn 610 and a second end 646 of the first fractional turn 602. In FIG. 6*c* interconnects 620/622 are on a single side of the core 604 while in FIG. 6*d*, both completely surround it.

Figure 6E:
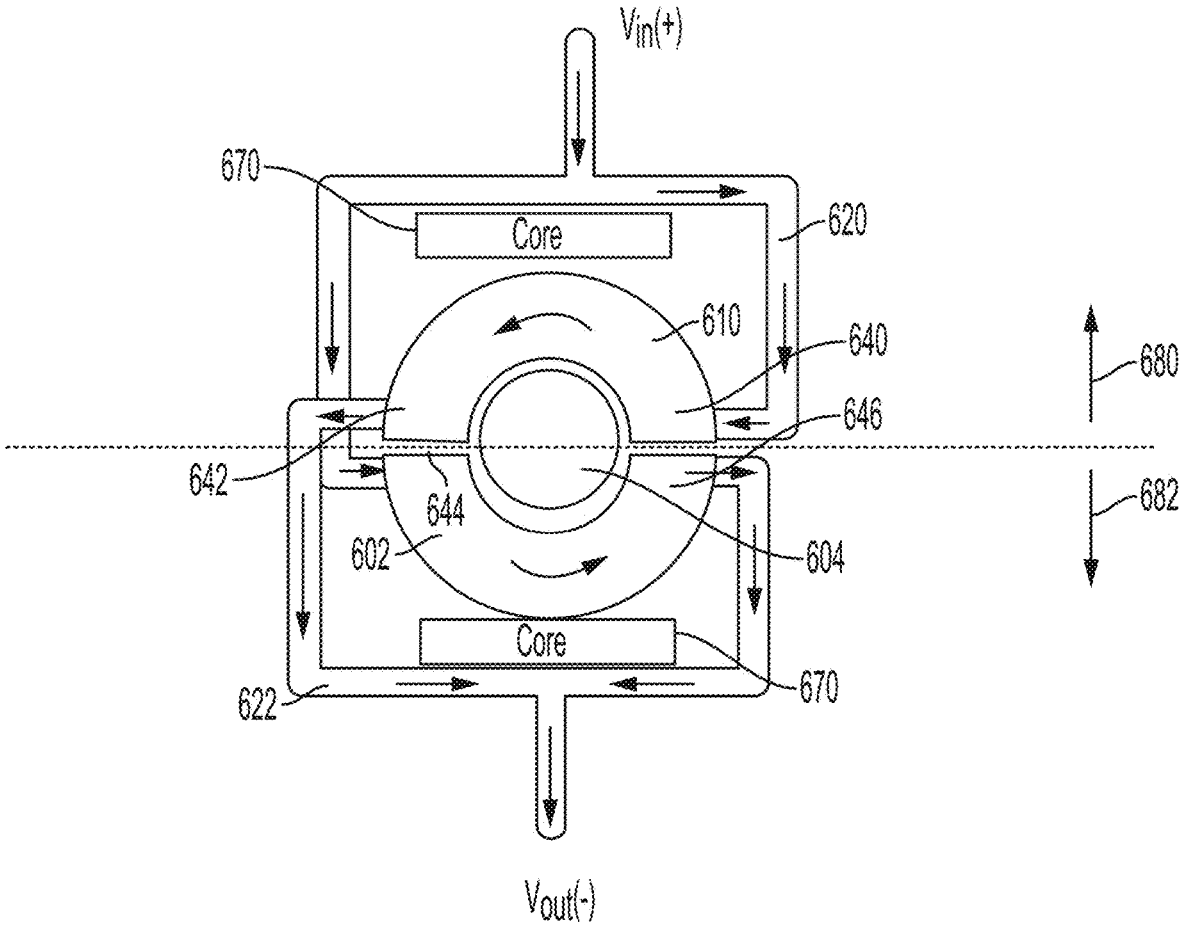

FIG. 6*e* is version of FIG. 6*c* where the first interconnect 620 is primarily on one side of the core 604 and the second interconnect 622 is primarily on the other side. "Primarily" in this context means more than 50%. For example, if the core 604 has first and second sides 680, 682 defined by axis X, more than 50% of the first interconnect 620 is on the first side 680 and is thus primarily on the first side 680 and more than 50% of the second interconnect 622 is on the second side 682 and is thus primarily on the second side 682.

In all of FIGS. 6*c*-6*e* the first interconnect 620 is connected an "input" side of the coil represented by the combination of first and second fractional turns 602, 610. This is shown in those figures by its connection to $V_{in}$(+). Similarly, the second interconnect 622 is connected an "output" side of the coil represented by the combination of first and second fractional turns 602, 610. This is shown in those figures by its connection to $V_{out}(-)$. The skilled artisan will realize thus such is merely a naming convention and the connections could made to different types of voltages/terminals depending on conditions. In FIGS. 6*c*-6*e* the fractional turns are shown being surrounded by external core arms 670. It shall be understood that the configurations of interconnects shown in these figures can be applied in other contexts. For example, the external core arms could be omitted in the case where a two-arm core (e.g., FIGS. 2, 3) and can be applied where multiple arms exist as shown in FIG. 4.

In prior example the windings on each "level" of a transformer have been encased in an enclosure. The fractional turns of any embodiment shown in FIGS. 6*a*-6*e* can also be so encased.

Figure 7:
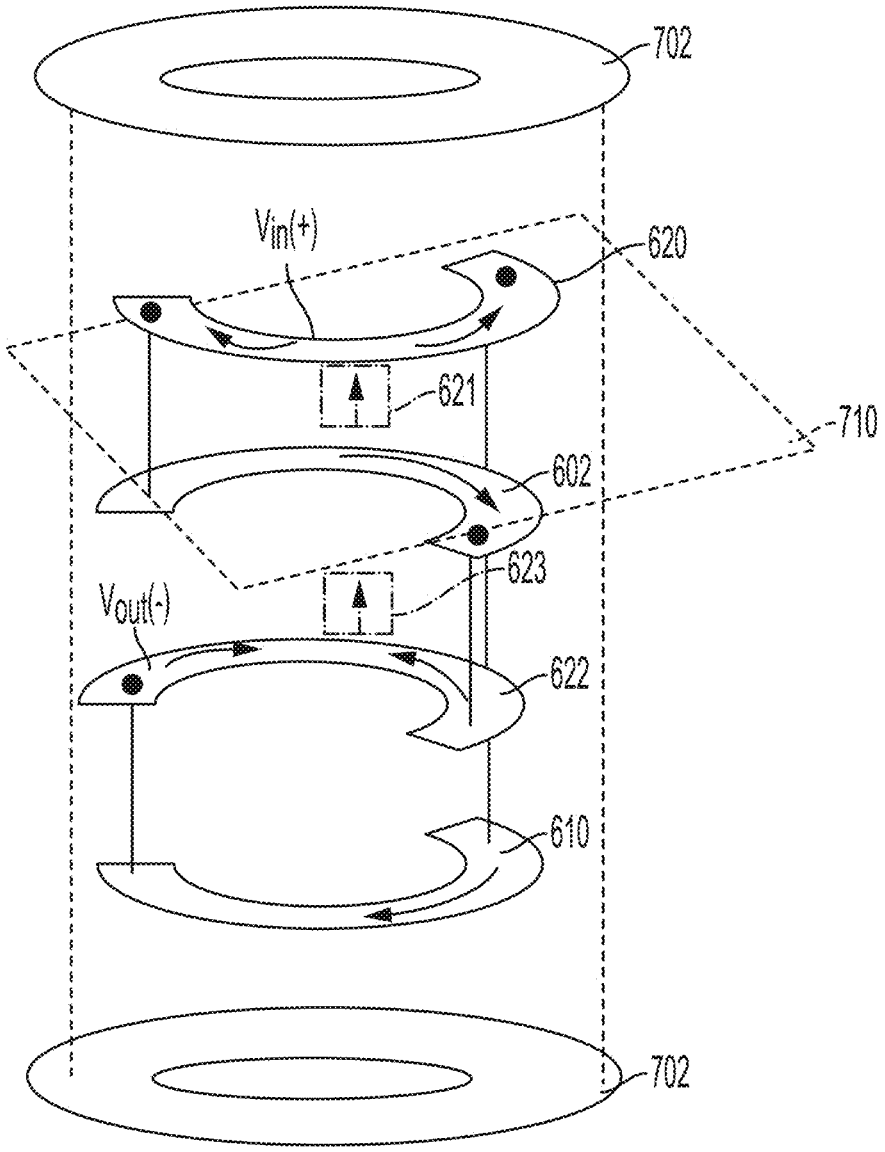
FIG. 7 shows an exploded view of an enclosure that can include the one or embodiments of the fractional turns disclosed in FIGS. 6*a*-6*e;*

For example, and with reference to FIG. 7, an enclosure can be provided that includes a top and bottom 702, 704 that encloses the first and second fractional turns 602, 610 and the first and second interconnects 620, 622. One or more separating layers 710 formed of an insulating material can be disposed between each element. The actual dimensions of the enclosure and number of windings therein can be varied based on the demands of the system.

In FIG. 7, the arrows on each fractional turn 602, 610 and interconnects 620, 622 represent a direction of induced current flow due to flux in the core (not shown) as described above. Of note is that the direction in first fractional turn 602 and the second fractional turn 610 are in opposite directions relative to the midline of the core. Current enters, in this example, fractional turn 620 via input 621 in the direction of the arrow therein and current leaves fractional turn 622 via output 623 in the direction of the arrow therein.

In one embodiment, the fractional windings and interconnects in any prior figure are formed of copper or another highly conductive metal.

High frequency wire losses caused by skin and proximity effects have been discovered in the case of a transformer that includes multiple secondary windings on same leg as one or more primaries. This is due to the discovered fact that boundary areas between primary and secondary windings where the magnetic field (H-field) changes direction have the highest H-field gradient. In such a region, currents displaced by the H-field cause a major increase in HF losses. For example, if there are two primary windings surrounding four secondary windings on each leg of a closed core, two leg transformer this results in the two outer secondary windings being such regions.

Figure 8:
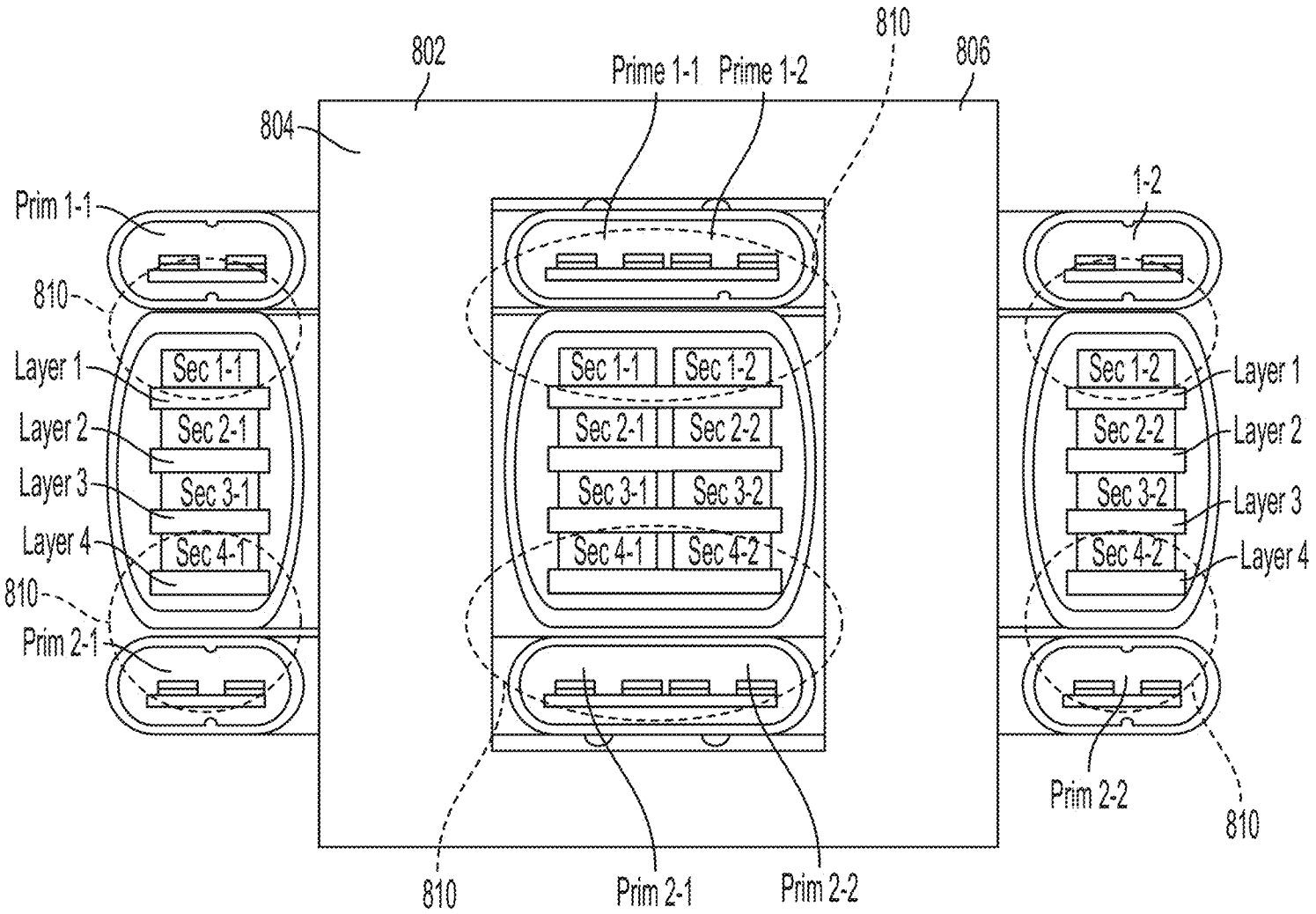
FIG. 8 is a two-leg transformer and includes multiple primary and multiple secondary windings.

For clarity, reference is made to FIG. 8. In FIG. 8, a transformer 800 includes a closed core 802. The core 802 includes first and second legs 804, 806. The transformer 800 includes a first primary having turns around the first and second legs 804, 806. The turns around the first leg are denoted as Prim 1-1 in FIG. 8 and the turns around the second leg are denoted as Prim 1-2. The transformer 800 includes a second primary having turns around the first and second legs 804, 806. The turns around the first leg are denoted as Prim 2-1 in FIG. 8 and the turns around the second leg are denoted as Prim 2-2. The turns in each of the first and second primaries can be connected to one another either in parallel or series.

Between these two primary windings are 4 secondary windings. These include a first secondary winding that includes turns around the first and second legs 804, 806. The turns of the first secondary around the first leg are denoted as SEC 1-1 in FIG. 8 and the turns around the second leg are denoted as SEC 1-2. Herein the first secondary is denoted as SEC 1-*x* and includes SEC 1-1/SEC 1-2). In the example of FIG. 8, the secondary turns around the first leg are denoted as SEC 2-1 and the turns around the second leg are denoted as SEC 2-2. Herein the first secondary is denoted as SEC 1-*x* and includes SEC 1-1/SEC 1-2). The same numbering convention also applies to the third and fourth secondary windings SEC 3-*x* and SEC 4-*x*.

As shown, the first secondary SEC 1-*x* is closest to the first primary PRIM 1-1/PRIM 1-2; referred to as PRIM 1-*x*). Adjacent the first secondary but further from the first primary than the first secondary winding is the second secondary winding SEC 2-*x*. The third secondary winding SEC 3-*x* is further from first primary than the second secondary winding SEC 2-*x* and the fourth secondary winding SEC 4-*x* is further from first primary than the third secondary winding SEC 3-*x*. From the bottom, the fourth secondary winding SEC 4-*x* is closer to the second primary (PRIM 2-*x*) than the third secondary winding SEC 3-*x* and so on.

The turns in each of the first through fourth secondaries can be connected to one another either in parallel or series.

As illustrated, each secondary winding is on a particular level. Thus, the first secondary is on the first level, the second secondary on the second level etc. However, this can result in a single secondary being in each region where the H-Field changes directions. These areas are generally shown by dashed ellipses 810. As illustrated, this means that the displaced currents, and thus losses, mainly exist in the first and fourth secondary windings (SEC 1-*x*; SEC 4-*x*).

Figure 9:
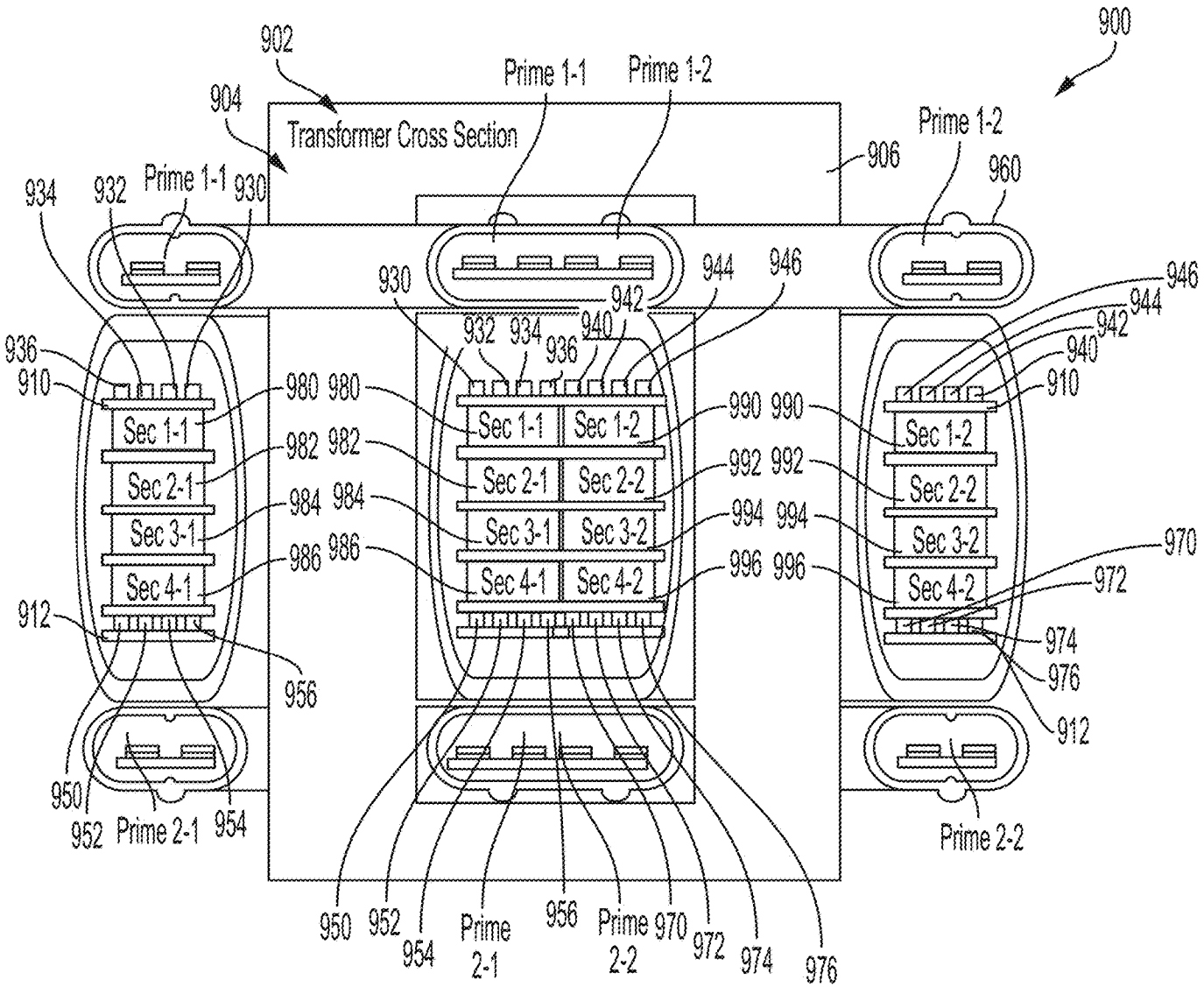
FIG. 9 is a two-leg transformer and includes multiple primary and multiple secondary windings that reduces loss concentration between windings.

With reference now to FIG. 9, to reduce this concentration of losses, in one embodiment, first and second inter-winding layers 910, 912 can be provided. The first inter-winding layer 902 is between the first primary PRIM 1-*x* and the first secondary winding SEC1-2 and the second inter-winding layer 904 is between the second primary PRIM 2-1 and the fourth secondary winding SEC 4-1.

The transformer 900 of FIG. 9 also includes a closed core 902. The core 902 includes first and second legs 904, 906. The transformer 900 includes first and second primaries having turns around the first leg 904. The first primary is Prim 1-1 in FIG. 9 and the second is denoted as Prim 2-1. The transformer 900 includes a third and fourth primaries (Prim 1-2 and 2-2) having turns around the second leg 906. The turns in each of the first and second primaries can be connected to one another either in parallel or series. Similar to above embodiments, Prim 1-1 causes a magnetic flux to flow in the first leg in a first direction and Prim 1-2 causes the magnetic flux to flow in the second leg in a second direction that is opposite from the first direction. In addition, in this and any prior embodiment, primary winding Prim 2-1 causes a magnetic flux to flow in the first leg in a first direction and primary winding Prim 2-2 causes the magnetic flux to flow in the second leg in a second direction that is opposite from the first direction.

Between these two primary windings on each leg are a plurality of secondary windings. As illustrated there are four windings, However, this is just an example and there could be anywhere from 1 to 10 secondary windings including 2, 3, 4 and 5 windings between the two primary windings.

The illustrated transformer 900 of FIG. 9 includes a first secondary winding that includes turns around the first leg 904 denoted as SEC 1-1 in FIG. 9 and a second secondary winding surrounding the second leg 906 denoted as SEC 1-2. The illustrated transformer also includes a third secondary winding that includes turns around the first leg 904 denoted as SEC 2-1 in FIG. 9 and a fourth secondary winding surrounding the second leg 906 denoted as SEC 2-2. The illustrated transformer also includes a fifth secondary winding that includes turns around the first leg 904 denoted as SEC 3-1 in FIG. 9 and a sixth secondary winding surrounding the second leg 906 denoted as SEC 3-2. The illustrated transformer also includes a seventh secondary winding that includes turns around the first leg 904 denoted as SEC 4-1 in FIG. 9 and an eighth secondary winding surrounding the second leg 906 denoted as SEC 4-2.

With respect to the first leg 904, the first secondary SEC 1-1 is closest to the first inter-winding layer 910. Adjacent the first secondary but further from the first inter-winding layer 910 than the first secondary winding is the third secondary winding SEC 2-1. The fifth secondary winding SEC 3-1 is further from the first inter-winding layer 910 than the third secondary winding SEC 2-1 and the seventh secondary winding SEC 4-1 is further from the first inter-winding layer 910 than the fifth secondary winding SEC 3-1. From the bottom, the second inter-winding layer 912 is closer to the second primary (PRIM2-2) than the seventh secondary winding SEC 4-1 and the seventh secondary windings 4-1 is closer to the second primary PRIM 2-2 than the fifth secondary winding SEC 3-1 and so on.

With respect to the second leg 906, the second secondary SEC 1-2 is closest to the first inter-winding layer 910. Adjacent the second secondary but further from the first inter-winding layer 910 than the second secondary winding is the fourth secondary winding SEC 2-2. The sixth secondary winding SEC 3-2 is further from the first inter-winding layer 910 than the fourth secondary winding SEC 2-2 and the eighth secondary winding SEC 4-2 is further from the first inter-winding layer 910 than the sixth secondary winding SEC 3-2. From the bottom, the second inter-winding layer 912 is closer to the second primary (PRIM2-2) than the eighth secondary winding SEC 4-2 and the eighth secondary windings 4-2 is closer to the second primary PRIM 2-2 than the sixth secondary winding SEC 3-2 and so on.

In general, the first and second secondary windings SEC 1-1/SEC 1-2 are on a first layer (Layer 1), the third and fourth secondary winding SEC 2-1/SEC2-2 are on a second layer (Layer 2), the fifth and sixth secondary windings SEC 3-1/SEC3-2 are on a third layer (Layer 3), and the seventh and eighth secondary windings SEC 4-1/SEC4-4 are on a fourth layer (Layer 4).

However, in contrast to FIG. 8, in FIG. 9, the first inter-winding layer 910 includes one or more turns of each of the secondary windings 1-1, 1-2, 1-3 and 1-4 as well as secondary windings 1-2, 2-2, 3-2 and 4-2. The second inter-winding layer 912 also includes one or more turns of each of the secondary windings 1-1, 1-2, 1-3 and 1-4 as well as secondary windings 1-2, 2-2, 3-2 and 4-2. The turns on the first interlayer winding layer 910 for SEC 1-1 to 4-1 are denoted by reference numerals 930, 932, 934, and 936 respectively. The turns on the second interlayer winding layer 912 for SEC 1-1 to 4-1 are denoted by reference numerals 950, 952, 954, and 956 respectively.

The turns on the first interlayer winding layer 910 for SEC 1-2 to 4-2 are denoted by reference numerals 940, 942, 944, and 946 respectively. The turns on the second interlayer winding layer 912 for SEC 1-2 to 4-2 are denoted by reference numerals 970, 972, 974, and 976 respectively.

To distinguish between turns on the first and second interlayer winding layers 910, 912 and those on the remaining turns of a particular winding, the remaining turns are given individual reference numbers. To this end, the remaining turns of SEC 1-1 to SEC 4-1 have reference numerals 980, 982, 984 and 986 assigned to them and the remaining turns of SEC 1-2 to SEC 4-2 have reference numerals 990, 992, 994 and 996 assigned to them.

In this manner, the boundary area losses of FIG. 8 are spread between multiple windings in the embodiment shown in FIG. 9. In the boundary area (e.g., on the first and inter-winding layers 910, 912) this can allow for smaller trace cross sections in the high H-field area and, thus, reduced HF losses on each secondary.

In order to produce a transformer such as transformer 900, enclosures can be provided to house the windings. For example, and with reference now to FIG. 9, the "top" primary windings PRIM 1-1 and PRIM 1-2 on the first and second legs 904, 906 can respectively be contained in a first enclosure 960. Similarly, PRIM 2-1 and PRIM 2-2 are enclosed in a second enclosure 962 and secondary windings (SEC) in a third enclosure 964. The windings in each enclosure 960-964 can receive or output current via inputs as described above. The skilled artisan will realize that different configurations of the windings in a particular enclosure can be selected to achieve desired input/output characteristics of the transformer. The enclosures can be similar to or the same as those shown in prior embodiments or they can take on a different form.

Figure 10:
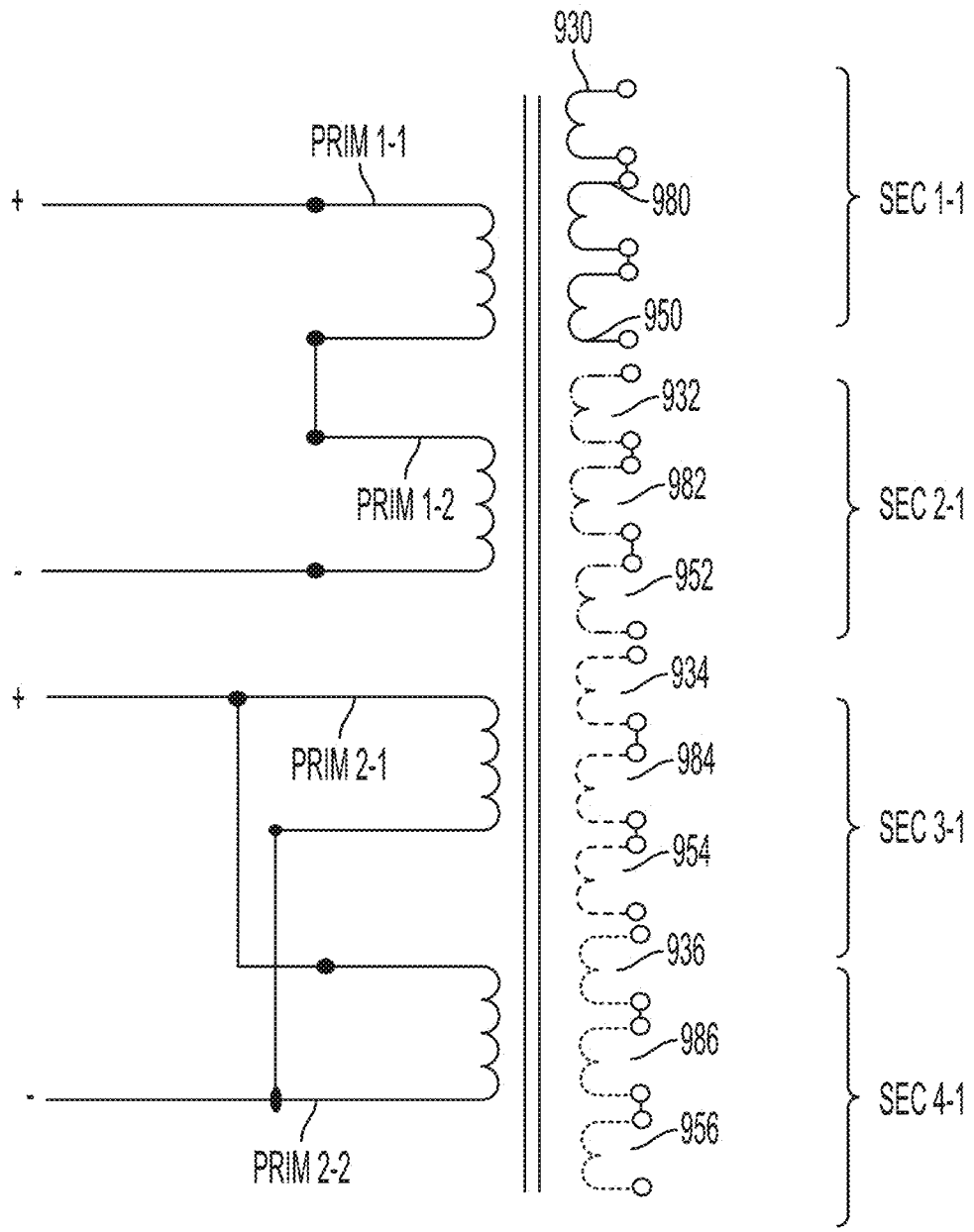
FIG. 10 is a circuit diagram of the transformer of FIG. 9.

FIG. 10 shows a circuit diagram of the transformer 900 of FIG. 9. In FIG. 10 the primary windings can be connected to one another is series or parallel or not at all. To illustrate and by way of example only, PRIM 1-1 and PRIM 1-2 are shown as connected in series and PRIM 2-1 and 2-2 are connected in parallel. The secondary windings SEC 1-1 to 4-1 are illustrated and SEC 1-2 to 4-2 are omitted for simplicity but is shall be understood that the non-illustrated secondary windings have a similar circuit representation. SEC 1-1 and SEC 1-2 may be also be connected in series or in parallel, similar to the other sets of secondary windings.

With reference to both FIGS. 9 and 10, the first secondary winding SEC 1-1 includes a first turn 930 that is on the first interlayer winding layer 910 and a second turn 950 that is on the second interlayer winding layer 912 with the remaining one or more turns 980 being a first layer that is labelled Layer 1 in FIG. 9. The second secondary winding SEC 1-2 includes a first turn 940 that is on the first interlayer winding layer 910 and a second turn 970 that is on the second interlayer winding layer 912 with the remaining one or more turns 990 being on Layer 1. Similarly, the third secondary winding SEC 2-1 includes a first turn 932 that is on the first interlayer winding layer 910 and a second turn 952 that is on the second interlayer winding layer 912 with the remaining one or more turns 982 on a second layer that is labelled Layer 2 in FIG. 9 and the fourth secondary winding SEC 2-2 includes a first turn 942 that is on the first interlayer winding layer 910 and a second turn 972 that is on the second interlayer winding layer 912 with the remaining one or more turns 992 on Layer 2. The fifth secondary winding SEC 3-1 includes a first turn 934 that is on the first interlayer winding layer 910 and a second turn 954 that is on the second interlayer winding layer 912 with the remaining one or more turns 984 on a third layer that is labelled Layer 2 in FIG. 9 and the sixth secondary winding SEC 3-2 includes a first turn 944 that is on the first interlayer winding layer 910 and a second turn 974 that is on the second interlayer winding layer 912 with the remaining one or more turns 994 on Layer 3. Lastly, the seventh secondary winding SEC 4-1 includes a first turn 936 that is on the first interlayer winding layer 910 and a second turn 956 that is on the second interlayer winding layer 912 with the remaining one or more turns 982 on a fourth layer that is labelled Layer 4 in FIG. 9 and the eighth secondary winding SEC 4-2 includes a first turn 946 that is on the first interlayer winding layer 910 and a second turn 976 that is on the second interlayer winding layer 912 with the remaining one or more turns 986 on Layer 4. In FIG. 9, the first, third, fifth and seventh secondary windings surround the first leg 904 and the second, fourth, sixth and eighth windings surround the second leg 906.

It has been discovered that if multiple parallel traces on a specific secondary level conduct currents in the same direction, skin and proximity effects will cause uneven current distribution producing additional HF losses. In one embodiment, this may be solved in a multiple secondary (e.g., four) transformer where the turns of the secondary are distributed and windings of adjacent secondaries carry current in opposite directions to reduce the HF losses.

Figure 11:
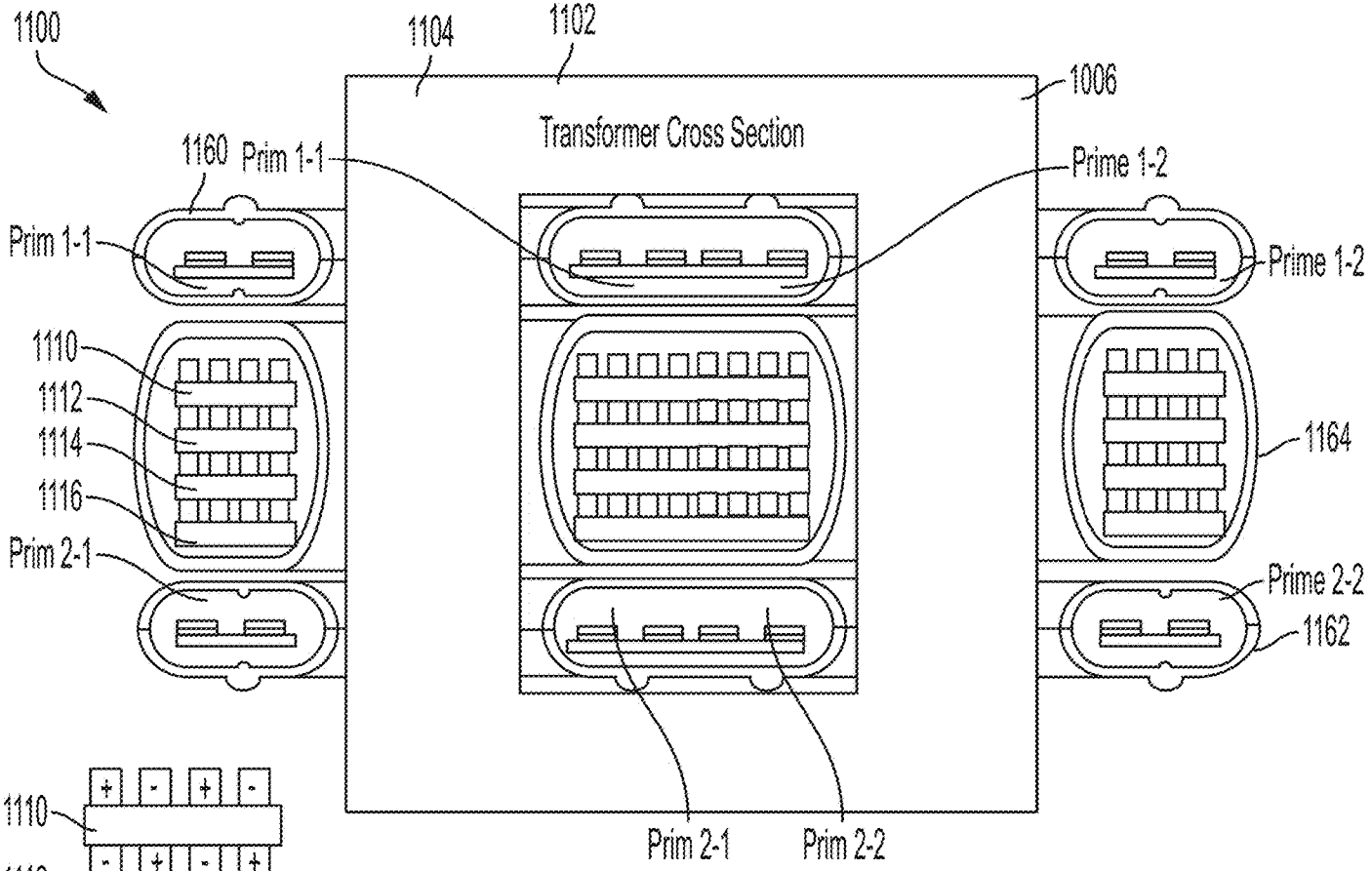
FIG. 11 is a two-leg transformer and includes multiple primary and multiple secondary windings that reduces skin and proximity losses between secondary windings.

With reference now to FIG. 11, to reduce the skin and proximity losses, a transformer 1100 is disclosed. The transformer 1100 of FIG. 11 includes a closed core 1102. The core 1102 includes first and second legs 1104, 1106. The transformer 1100 includes a first and second primaries having turns around the first leg 1104. The first primary is Prim 1-1 in FIG. 11 and the second is denoted as Prim 2-1. The transformer 1100 includes third and fourth primaries (Prim 1-2 and 2-2) having turns around the second leg 1106. The turns in each of the first and second primaries can be connected to one another either in parallel or series. Similar to above embodiments, Prim 1-1 causes a magnetic flux to flow in the first leg in a first direction and Prim 1-2 causes the magnetic flux to flow in the second leg in a second direction that is opposite from the first direction. In addition, in this and any prior embodiment, primary winding Prim 2-1 causes a magnetic flux to flow in the first leg in a first direction and the primary winding Prim 2-2 causes the magnetic flux to flow in the second leg in a second direction that is opposite from the first direction. As shown, all of the primary windings include 2 turns but that is not required and any number of turns can be utilized.

Between these two primary windings on each leg are a plurality of secondary windings. As illustrated there are two windings on each leg. Each winding is distributed across four layers with two turns on each layer.

In more detail, the illustrated transformer 1100 of FIG. 11 includes a first secondary winding that includes turns around the first leg 1104. In FIG. 11, the first secondary winding includes turns distributed on four layers 1110-1118. The illustrated transformer 1100 of FIG. 11 includes a second secondary winding that includes turns around the first leg 1104. In FIG. 11, the second secondary winding includes turns distributed on four layers 1110-1118.

Figure 12:
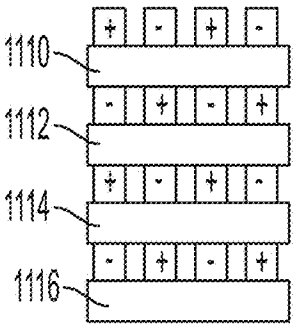
FIG. 12 shows two secondary windings distributed on four levels.

While not all turns are individually labelled, reference can be made to FIG. 12 which shows turns of the first winding that surround the first leg 1104 bearing a (+) sign and those of the second winding bearing a (−) sign. The windings are arranged such that current flows in one direction (e.g., out of page) in the turns of the first secondary winding and an opposite direction (e.g., into to the page) in turns of the secondary winding. Stated differently, current flows in a first direction around the first leg in turns of the first secondary winding and current flows in second, opposite, direction around the first leg in turns of the second secondary winding.

In order to produce a transformer such as transformer 1100, enclosures can be provided to house the windings. For example, and with reference now to FIG. 11, the "top" primary windings PRIM 1-1 and PRIM 1-2 on the first and second legs 1104, 106 can respectively be contained in a first enclosure 1160. Similarly, PRIM 2-1 and PRIM 2-2 in enclosed in a second enclosure 1162 and secondary windings (SEC) in a third enclosure 1164. The windings in each enclosure 960-964 can receive or output current via inputs as described above. The skilled artisan will realize that different configurations of the windings in a particular enclosure can be selected to achieve desired input/output characteristics of the transformer. The enclosures can be similar to or the same as those shown in prior embodiments or they can take on a different form.

Figure 13:
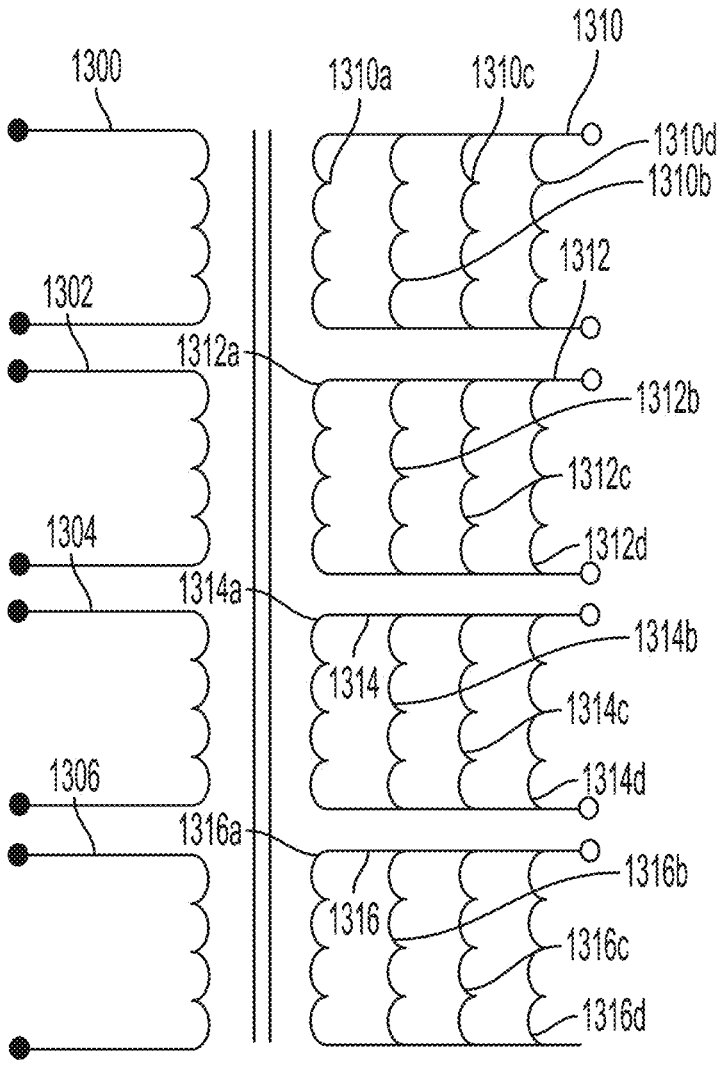
FIG. 13 is a circuit diagram of the transformer of FIG. 11.

FIG. 13 shows a circuit diagram of the transformer 1100 of FIG. 11. The transformer includes first and second primary windings 1300, 1302. These windings surround the first leg 1104. The transformer also includes first and second secondary windings 1310, 1312, the first and second secondary windings 1310, 1312 having four groupings or sets of windings 1310*a*-1310*d* and 1312*a*-1312*d*, respectively. Each set of windings 1310*a*-1310*d* and 1312*a*-1312*d* can be formed of one or more (e.g. 2) turns and is on a different level. In relation to FIG. 11, the winding sets 1310*a* and 1312*a* can be on the first level 1110, the winding sets 1310*b* and 1312*b* can be on the second level 1112, the winding sets 1310*c* and 312*c* can be on the third level 1114, and the winding sets 1310*d* and 1312*d* can be on the fourth level 1116. As discussed above, current flows in a first direction around the first leg in the first secondary winding 1310 and current flows in second direction around the first leg in the second secondary winding 1312.

The transformer includes third and fourth primary windings 1304, 1306. These windings surround the second leg 1104. The transformer also includes third and fourth secondary windings 1313, 1316. The first and second secondary windings 1310, 1312 having four grouping or set of windings 1314*a*-1314*d* and 1316*a*-1316*d*, respectively. Each set of windings 1314*a*-1314*d* and 1316*a*-1316*d* can be formed of one or more (e.g. 2) turns and is on a different level. In relation to FIG. 11, the winding sets 1314*a* and 1316*b* can be on the first level 1110, the winding sets 1314*b* and 1316*b* can be on the second level 1112, the winding sets 1314*c* and 1316*c* can be on the third level 1114, and the winding sets 1314*d* and 1316*d* can be on the fourth level 1116. As discussed above, current flows in a first direction around the second leg in the third secondary winding 1314 and current flows in second direction around the second leg in the fourth secondary winding 1316.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts and equivalents of all means or step plus function elements in the claims below are intended to include any structure, material or act for performing the function in combination with other claimed elements as claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While embodiments have been described, it will be understood that those skilled in the art, both now and in the future, may make various improvements and enhancements which fall within the scope of the claims which follow. These claims should be construed to maintain the proper protection for the invention first described.

What is claimed is:

1. A transformer comprising:

a closed loop core having a first leg and a second leg;

a first primary winding surrounding the first leg;

a second primary winding surrounding the first leg; and first and second secondary windings surrounding the first leg and disposed between the first and second primary windings;

wherein the first and second secondary windings are disturbed on four levels, with two turns of each of the first and second secondary windings being on each of the four levels; and wherein current flows in a first direction around the first leg in the first secondary winding and current flows in second direction around the first leg in the second secondary winding, the second direction being opposite the first direction;

a third primary winding surrounding the second leg;

a fourth primary winding surrounding the second leg;

third and fourth secondary windings surrounding the second leg and disposed between the third and fourth primary windings;

wherein the third and fourth secondary windings are disturbed on the four levels, with two turns of each of the third and fourth secondary windings being on each of the four levels;

wherein current flows in first direction around the second leg in the third secondary winding and current flows in second direction around the second leg in the second secondary winding, the second direction being opposite the first direction;

a first enclosure that includes the first primary winding;

a second enclosure that includes the second primary winding; and a third enclosure that includes the first secondary winding and the second secondary winding.

2. The transformer of claim 1, wherein the third enclosure includes the third and fourth secondary windings.

3. The transformer of claim 1, wherein the first enclosure includes the third primary winding and the second enclosure includes the fourth primary winding.

* * * * *